United States Patent [19]

Hani

[11] Patent Number: 4,722,359

[45] Date of Patent: Feb. 2, 1988

[54] VALVE ARRANGEMENT FOR HIGH PRESSURE PUMPS

[75] Inventor: Franz Hani, Geretsried, Fed. Rep. of Germany

[73] Assignee: Speck-Kolbenpumpen-Fabrik Otto Speck KG, Fed. Rep. of Germany

[21] Appl. No.: 849,311

[22] Filed: Apr. 8, 1986

[30] Foreign Application Priority Data

Apr. 9, 1985 [DE] Fed. Rep. of Germany ..... 3512696

[51] Int. Cl.[4] ..... F16K 17/06

[52] U.S. Cl. ..... 137/116; 137/539.5

[58] Field of Search ..... 137/115, 116

[56] References Cited

U.S. PATENT DOCUMENTS

| | | | |
|---|---|---|---|
| 2,174,797 | 10/1939 | Magnuson . | |
| 2,313,351 | 3/1943 | Magnuson . | |
| 2,342,001 | 2/1944 | Magnuson . | |
| 2,362,713 | 11/1944 | Mott | 137/116 X |
| 2,397,117 | 3/1946 | Ashton et al. . | |
| 2,487,575 | 11/1949 | Mercier . | |
| 2,622,611 | 12/1952 | Stark . | |
| 3,575,192 | 4/1971 | MacDuff | 137/116 |
| 3,608,824 | 9/1971 | Ballou . | |
| 3,834,413 | 9/1974 | Peterson | 137/116 |
| 3,848,619 | 11/1974 | Cochrane | 137/116 |
| 4,246,924 | 1/1981 | Droitsch et al. . | |

FOREIGN PATENT DOCUMENTS

| | | | |
|---|---|---|---|
| 3037259A1 | 4/1982 | Fed. Rep. of Germany . | |
| Ad.70269 | 3/1959 | France | 137/116 |
| 567645 | 2/1945 | United Kingdom | 137/116 |

*Primary Examiner*—Robert G. Nilson

*Attorney, Agent, or Firm*—Townsend and Townsend

[57] ABSTRACT

A relief valve for high pressure pumps is described which is characterized by its extremely compact construction and complete reliability against leakage. The relief valve has a valve ball in the bypass path which is pressed by a high and preferably adjustable force against the valve seat, by means of a compression spring which is located entirely in the housing of the unloader. The spigot which acts against the ball in the bypass path is actuated by means of a piston which is acted on by the output pressure over its entire cross-sectional area.

12 Claims, 3 Drawing Figures

VALVE ARRANGEMENT FOR HIGH PRESSURE PUMPS

The invention relates to a valve arrangement, and in particular to a relief valve or unloader for high pressure pumps. A known relief valve of this kind is disclosed in German Offenlegungsschrift No. 27 04 754 and comprises a housing with an inlet; a main flow path extending from this inlet to a working outlet; a check valve provided in said main flow path; a bypass flow path leading from the inlet to a bypass outlet; and a valve element arranged in said bypass flow path. The valve element is controllable in dependence on the pressure in the main flow path, and includes a ball which contacts a valve seat under spring bias and which can be loaded by an actuating spigot which is connected to a piston acted on by the pressure prevailing at said working outlet.

The object underlying the present invention is to provide an extremely compact valve arrangement of this kind which is characterised by being particularly secure against leakage and by the smooth running of the movable parts, and which is particularly suited for direct integration into a pump housing.

This object is satisfied, in a device of the initially named kind in that the piston is biased against the working pressure by means of a spring which surrounds the actuating spigot and is arranged in a receiving chamber between the piston and an opening associated with the ball.

The ball which cooperates with the spigot is preferably pressed against its valve seat by means of a second spring the force of which is substantially larger than the bias force of the first said spring associated with the piston.

Particularly important features/advantages of the presently claimed arrangement are:

(a) that no movable element, and in particular no piston rod, needs to be guided out through the valve housing;

(b) that the movable elements, in particular the piston which actuates the spigot and the plunger which biases the bypass ball, can be ideally guided;

(c) that the piston can be acted on over its entire cross-sectional area by the pressure at the outlet side, and can thus be made of a comparatively small area;

(d) that small stroke movements of the piston can be permitted in dependence on permissible pressure fluctuations in the outlet circuit without any actuation of the valve in the bypass, as a result of the spring associated with the actuating piston and the adjustable play between the actuating spigot and the bypass ball;

(e) that a reliable and leakage-free closure of the housing is made possible via sealed threaded plugs; and (f) that a simple sealing (for example with lead seals) can counteract wilful adjustments of the release pressure.

Particularly advantageous embodiments of the valve arrangement are described in the appended subordinate claims.

Figure 1:
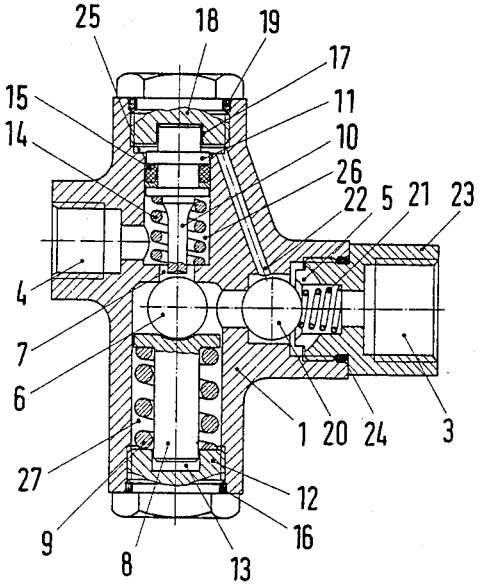
Figure 2:
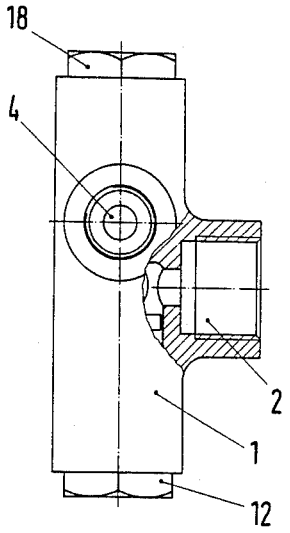
Figure 3:
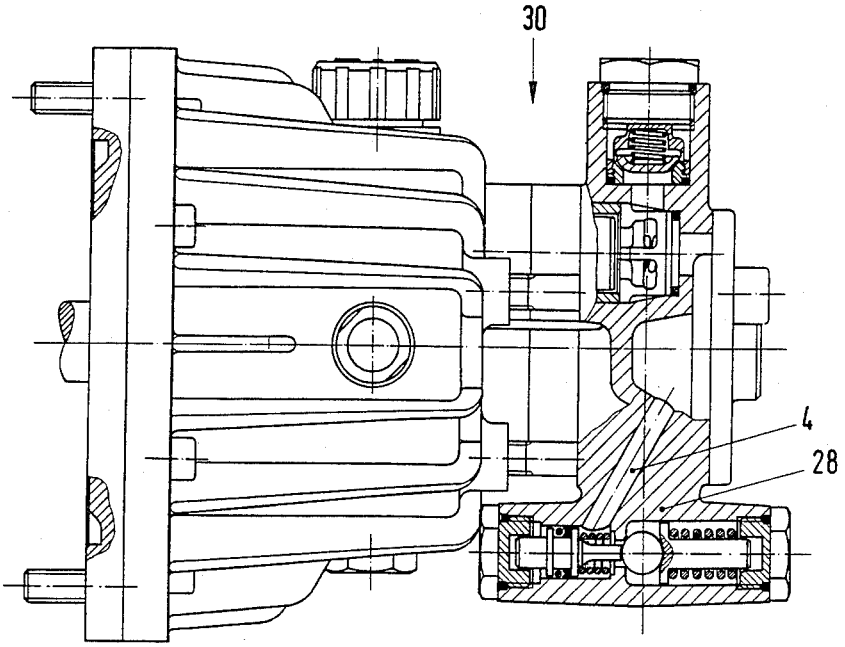

An embodiment of the invention will now be explained in more detail with reference to the drawings which show:

FIG. 1 a schematic sectional view of an unloader in accordance with the invention, FIG. 2 a sideview of the unloader of FIG. 1, and FIG. 3 a pump arrangement shown partly sectioned with an integrated unloader.

As seen in FIG. 1 straight bores and threaded bores are provided in a housing 1 from different sides and serve to receive the functional parts of the unloader. All these bores are arranged so that they can be formed without problem in the housing body by means of automatic machines, such as NC machine tools and machining centers.

The inlet opening 2 lies, as shown by FIG. 2, approximately half way up the housing 1 and an outlet 3 is provided at the same level but displaced through 90° relative to the inlet. The main flow path extends between the inlet 2 and the outlet 3.

A check valve (non return valve) 5 is arranged in this main flow path and consists, in the illustrated embodiment, of a ball 20 with an associated bias spring 21. The bias spring 21 is mounted in a threaded insert 23 which is sealed relative to the housing 1 via a seal 24. This arrangement is characterised by its particular ease of assembly on the one hand and by its low flow resistance on the other hand.

A bypass flow path branches off from the main flow path and is closed in the normal case by a valve ball 6 which is pressed against a corresponding valve seat at an opening 7 under the bias of a spring 9. The bypass flow path extends via the opening 7 into a receiving chamber 26 and from there through a bore which branches off radially to the bypass outlet 4. The bias spring 9 which presses the ball 6 against its seating surface is arranged in a bore 27 and is braced by one end against a plunger 8 which contacts the ball 6, and at the other end against a threaded plug 12 which is sealed relative to the housing 1 by means of a seal 16. A guide recess 13 is provided in the threaded plug into which the free end of the plunger 8 engages. The ball-side end of the plunger 8 has an end flange which serves to guide the plunger 8 in the bore 27. In this way the plunger 8 is actually guided at both ends. A part-spherical recess is provided in the end flange which, in accordance with the invention assists in ensuring reliable seating of the ball 6.

The threaded plug 12 is preferably adjustable and makes it possible in this manner to adjust the bias of the compression coil spring 9. There is preferably a possibility of sealing the threaded plug 12, for example with a leaded seal, so that once set the bias force of the spring 9 can be retained and can be checked for tampering.

An actuating spigot 10 which is connected with a piston 11, or formed in one piece with this piston 11 is provided in the previously mentioned receiving chamber 26 on the side of the ball 6 remote from the plunger 8. This spigot has the task of lifting the ball 6 from the valve seat and opening the bypass flow path in the event of an impermissibly high outlet pressure.

The piston 11 is pressed or biased in the direction away from the ball 6 by a compression coil spring 14 which is arranged in the receiving chamber 26 and which surrounds the actuating spigot 10. This spring 14 is seated for this purpose with one end on a ring shoulder formed in the housing 1 and with its other end on a shoulder region of the piston 11.

The piston 11 is sealed by means of a seal 15 relative to the wall of the receiving chamber 26.

A pressure chamber 25 is located at theside of the piston 11 opposite to the actuating spigot 10 and is connected via a straight bore 22 formed in the housing 1 to the outlet side of the unloader. The bore opens preferably into the region of the corresponding flow passage disposed after the valve ball 20.

The pressure chamber 25 is outwardly bounded by a threaded plug 18 which is sealed relative to the housing 1 by means of a seal 19.

The threaded plug 18 has a ring-like, pot-shaped recess 17 into which a corresponding projection of the piston 11 engages, with the projection of the piston 11 having a shape (cross-section) corresponding substantially to that of the recess. In this way an additional guidance of the piston is obtained.

It is of particular importance that the entire cross-sectional area of the piston 11 on the pressure chamber side is available for the pressure loading which makes a substantial reduction of the constructional dimensions possible in comparison to customary unloaders in which a pressure rod has to be led out of the housing. The force of the bias spring 9 which presses the ball 6 against its seating surface is substantially greater than the corresponding bias force of the spring 14 for the piston 11, i.e. the function of the bias spring normally provided in customary unloaders outside of the housing is effected in the unloader of the invention by the bias spring 9 which is located entirely within the housing. Accordingly this spring 9 is dimensioned so that it is considerably stronger than the spring 14.

Furthermore, it is of substantial advantage that no movable parts need to be led out of the housing, and accordingly that no sealing or leakage problems arise. In addition the friction losses are correspondingly reduced which has a positive effect with regard to reliable functioning of the device.

The adjustment of the bias force of the spring 9 via a threaded plug 12 is likewise possible without problem and without any loss of water.

FIG. 3 shows the integration of an unloader in accordance with the invention directly into the housing 28 of a pump 30. In this arrangement the unloader is arranged in space saving manner in the vicinity of the outer periphery of the pump 30, which is possible as a result of its extremely compact shape. The longitudinal axis of the unloader extends in this arrangement at least substantially parallel to the drive axis of the pump, which, in the illustrated embodiment is a swash plate pump. The inlet opening of the unloader is connected with the high pressure side of the pump via a passage formed in the housing, and a connection bore 4 which is led back to the suction side is also provided for the bypass.

What is claimed:

1. A relief valve for a high pressure pump, the relief valve comprising:

a housing having an inlet, working outlet and a bypass outlet;

a mian flow path extending from said inlet to said working outlet;

a check valve provided in said main flow path;

a bypass flow path leading from said inlet to said by pass outlet;

an opening in wall means of said housing and forming part of said bypass flow path;

valve means arranged in said bypass flow path, said valve means includng a valve seat surrounding said opening on a first side of said wall means, a ball, a first spring for biasing said ball into contact with said valve seat, an actuating spigot for pressing said ball away from said valve seat, a piston operatively connected to said spigot and having first and second sides, and a second spring disposed on said first side of said piston and surrounding said spigot for pushing said piston and said spigot away from said ball into an inoperative position in which said spigot is spaced from asid ball when said ball is in contact with said valve seat;

passage means extending form said main flow path to said second side of said piston for subjecting said piston to a working prevailing in said main flow path;

a receiving chamber formed on an opposite side of said wall means from said valve seat for accommodating said second spring, said piston and said spigot, whereby said valve means is controlled by said working pressure and is operative to free said bypass flow path when said working pressure rises above a predetermined level, wherein said first and second coil springs are compression coil springs which are coaxially arranged with the force of said first spring for biasing said ball against said seat being substantially larger than the bias force of said second spring for biasing said piston and said spigot away from said ball, wherein said first coil spring acts on a plunger which contacts said ball, said plunger being guided in a first bore of said housing in the manner of a piston and being constructed with a ring-like flange at its end adjacent said ball, said ring-like flange having a guide function relative to said first bore; and wherein said end of said plunger remote from said ball engages in a guide recess of a sealed threaded plug, said threaded plug being constructed for the adjustment of the bias of the second spring.

2. A relief valve for a high pressure pump, the relief valve comprising:

a housing having an inlet, a working outlet, and a bypass outlet;

a main flow path extending from said inlet to said working outlet;

a check valve providing in said main flow path;

a bypass flow path leading from said inlet to said bypass outlet;

an opening in wall means of said housing and forming part of said bypass flow path;

valve means arranged in said bypass flow path, said valve means including a valve seat surrounding said opening on a first side of asid wall means, a ball, a first spring for biasing asid ball into contact with said valve seat, an actuating spigot for pressing said ball away form said valve seat, a piston operatively connected to said spigot and having first and second sides, and a second spring disposed on said first side of said piston and surrounding said spigot for pushing said piston and said spigot away from said ball into an inoperative position in which said spigot is spaced from said ball when said ball is in contact with said valve seat;

passage means extending from said main flow path to said second side of said piston for subjecting said piston to working pressure prevailing in said main flow path;

a receiving chamber formed on an opposite side of said wall means from said valve seat for accommodating said second spring, said piston and said spigot, whereby said valve means is controlled by said working pressure and is operative to free said bypass flow path when said working pressure rises above a predetermined level; and wherein said piston has a cylindrical projection at its second said, said cylindrical projection engaging in a guide recess of said housing.

3. A relief valve in accordance with claim 2, wherein said guide recess is provided in a threaded plug provided for closing an end of a bore defining said receiving chamber.

4. A relief valve for a high pressure pump, the relief valve comprising:

a housing having an inlet, a working outlet, and a bypass outlet;

a main flow path extending from said inlet to said working outlet;

a check valve provided in said mian flow path;

a bypass flow path leading from said inlet to said bypass outlet;

an opening in wall means of said housing and forming part of said bypass flow path;

valve means arranged in said bypass flow path, said valve means including a valve seat surrounding said opening on a first side of said wall means, a ball, a first spring for biasing said ball into contact with said valve seat, said first spring acting on a plunger or pressure tappet which contact said ball, said plunger being guided in a bore of said housing in the manner of a piston, said plunger being constructed with a ring-like flange at its end adjacent said ball, said ring-like flange having a guide function relative to said bore, the outer end of said plunger remote from said ball engaging in a guide recess of a sealed, threaded, plug, an actuating spigot for pressing said ball away from said valve seat, a piston operatively connected to said spigot and having first and second sides, and a second spring disposeod on said first side of said piston and surrounding said spigot for pushing said piston and said spigot away from said ball and into an inoperative position in which said spigot is spaced from said ball when said ball is in contact with said valve seat, the bias force of said first spring being substantially larger than the bias force of said second spring;

passage means extending from said main flow path to said second side of said piston for subjecting said piston to a working pressure prevailing in said main flow path; and a receiving chamber formed on an opposite side of said wall means form said valve seat for accommodating said second spring, said piston, and said spigot, whereby said valve means is controlled by said working pressure and is operative to free said bypass flow path when said working pressure rises above a predetermined level.

5. A valve arrangement in accordance with claim 4, characterized in that the threaded plug is constructed for the adjustment of the bias of the second spring.

6. A valve arrangement in accordance with claim 4, characterized in that the threaded plug can be sealed, i.e., can in particular be provided with a lead seal.

7. A valve arrangement in accordance with claim 4, characterized in that a bore leading to the bypass outlet extends radially away from the receiving chamber for the spigot and the first compression spring.

8. A valve arrangement in accordance with claim 4, characterized in that the piston which is guided in the receiving chamber and sealed relative to the wall of this bore by means of a seal is acted on at its side adjacent a pressure chamber of its full cross-sectional area by the outlet pressure.

9. A valve arrangement in accordance with claim 8, characterized in that the piston has a preferably cylindrical projection at its pressure chamber side which engages a guide recess in a second threaded plug.

10. A valve arrangement in accordance with claim 4, characterized in that the check valve at the working outlet side consists of a ball under the bias of a third spring.

11. A valve arrangement in accordance with claim 10, characterized in that said third bias spring is braced inside a threaded insert.

12. A valve arrangement in accordance with claim 4, characterized in that the central axes of the inlet and of the outlet are disposed in the same plane.

* * * * *